US006895984B1

(12) United States Patent
Pansini

(10) Patent No.: US 6,895,984 B1
(45) Date of Patent: May 24, 2005

(54) POOL CLEANER DEPLOYMENT ARRANGEMENT

(76) Inventor: Andrew L. Pansini, 200 Golden Gate Ave., Belvedere, CA (US) 94920

( * ) Notice: Subject to any disclaimer, the term of this patent is extended or adjusted under 35 U.S.C. 154(b) by 0 days.

(21) Appl. No.: 10/758,880

(22) Filed: Jan. 16, 2004

(51) Int. Cl.[7] ..... B65H 75/34
(52) U.S. Cl. ..... 137/1; 137/355.16; 4/490; 15/1.7
(58) Field of Search ..... 137/355.16, 355.28, 137/1; 4/490; 15/1.7

(56) References Cited

U.S. PATENT DOCUMENTS 3,139,099 A * 6/1964 Anthony ..... 15/1.7
3,278,949 A * 10/1966 Whitaker ..... 4/490
3,289,216 A * 12/1966 Anthony et al. ..... 4/490
3,392,738 A * 7/1968 Pansini ..... 4/490
4,228,553 A * 10/1980 Genuit ..... 4/490
4,281,995 A * 8/1981 Pansini ..... 134/167 R
4,348,192 A * 9/1982 Pansini ..... 4/490
4,768,532 A * 9/1988 Johnson ..... 15/1.7

* cited by examiner

*Primary Examiner*—Kevin Lee
(74) *Attorney, Agent, or Firm*—Howard Cohen

(57) ABSTRACT

In conjunction with a pool cleaning apparatus having a flexible hose supported by floats, an apparatus for deploying the hose into the pool includes at least one tube through which the hose extends. A plurality of water jets extend into the tube downstream from the entrance and are angled obliquely toward the outer, pool end of the tube. The jets interact with the floats to drive the floats and the hose into the pool. A pressure chamber may be provided surrounding the tube to supply the jets.

13 Claims, 2 Drawing Sheets

POOL CLEANER DEPLOYMENT ARRANGEMENT

CROSS-REFERENCE TO RELATED APPLICATIONS

Not Applicable.

FEDERALLY SPONSORED RESEARCH

Not applicable.

SQEUENCE LISTING, ETC ON CD

Not applicable.

BACKGROUND OF THE INVENTION

1. Field of the Invention

This invention relates to apparatus for cleaning a swimming pool and, more particularly, to an improved arrangement for deploying a pool cleaning device.

2. Description of Related Art

There are known in the prior art various devices for cleaning the water within a swimming pool. In addition to the stationary, plumbed water circulation system that a swimming pool requires, with its pump, filter, and heater, many pools also are equipped with a system for removing sunken objects from the floor of the pool. Such objects may include leaves and other tree debris, insects, garden detritus, and the like. Although the sunken objects may be removed manually using a vacuum mounted on a long pole, many pool owners employ an automated system for maintaining the pool in as clean a state as possible.

One pool cleaning device that is widely popular and successful comprises a sunken cleaning head secured at the distal end of a floating flexible hose assembly. The hose assembly supplies pool water under pressure to the cleaning head, and the head creates a Venturi action that attracts floating debris and enables their capture and removal by the cleaning head. The hose assembly is typically mounted on a take-up reel disposed adjacent to the perimeter of the pool, and the cleaning head is stored in a storage cavity or receptacle formed in the upper sidewall of the pool and adjacent to the take-up reel.

The hose assembly is typically comprised of a plurality of floats spaced apart along the flexible hose, as well as a plurality of swivel couplings spaced apart therealong to prevent twisting and knotting of the flexible hose. When the hose is deployed and the cleaning head is released onto the surface of the pool water, the cleaning head is driven by jet action of the water passing therethrough to move forward in a random manner about the surface, thereby assuring that all areas of the pool floor will be cleaned. An exemplary method and apparatus are described in copending U.S. application Ser. No. 10/078,802, filed by the present inventor.

Although it would be ideal to be able to deploy the flexible hose and cleaning head automatically, there are physical factors that mitigate against merely paying out the hose from the take-up reel. The hose is typically too flexible to be pushed out of the storage receptacle into the pool, and the cleaning head cannot generate sufficient jet thrust to pull the hose out into the pool. As a result, it is necessary to manually set out the hose and cleaning head. The hose and head may be easily retracted by rotating the take-up reel and pulling the assembly into the reel, so that the cleaning cycle may be ended without manual intervention. However, automating the entire cleaning cycle, including initial deployment, is a feature that has eluded all efforts known in the prior art.

BRIEF SUMMARY OF THE INVENTION

The present invention generally comprises an improved deployment apparatus for an automatic swimming pool cleaning device that incorporates a cleaning head secured to a retractable hose assembly. The apparatus of the invention drives the cleaning head and hose assembly outwardly from a take-up reel into the pool itself, so that the pool cleaning cycle may be initiated without requiring manual effort.

A salient aspect of the invention is a jet tube assembly through which the hose assembly extends, the jet tube assembly being interposed between the take-up reel and the outlet to the pool. In one embodiment, the jet tube assembly includes a first tube having an internal diameter slightly larger that the outer diameter of the floats provided on the hose assembly. A second tube is disposed concentrically about the first tube, and defines therebetween a sealed pressure chamber. The pressure chamber is connected to a source of water under pressure. A plurality of water jets are disposed in the wall of the first tube, and are supplied by the water in the pressure chamber. The jets are angled to project streams of water toward the outlet end of the tube. Due to the fact that the ID of the first tube is only slightly larger than the OD of the floats, the floats are subject to a piston or bullet effect in which the pressure and momentum of the jets forces the floats toward the outlet end, thus driving the hose assembly outwardly to the pool. The length of the jet tube assembly is sufficient to assure that at least one, and preferably two floats are entrained in the jet tube at any instant, thereby assuring that the entire hose assembly is fed out into the pool.

In a further embodiment of the invention, the jet tube assembly may comprise a single tube having dimensions similar to the first tube described in the previous embodiment. One or more water jets extend through the single tube and are angled toward the outlet end, the jets being supplied by connection to a water pressure source. The jets propel the floats of the hose assembly toward the outlet end and the pool, as described previously, to pay out the hose assembly into the pool. Thereafter, the pool cleaner is operated as known in the prior art, with pressurized water supplied by the hose powering the cleaning head at the end of the hose.

In either embodiment, an outer tube may be provided to connect the hose reel housing to the pool, so that water from the pool may enter the housing to replace water displaced by the water jet emission into the pool.

DETAILED DESCRIPTION OF THE INVENTION

The present invention generally comprises an improved deployment apparatus for an automatic swimming pool cleaning device that incorporates a cleaning head secured to a retractable floating hose assembly. The apparatus of the invention drives the cleaning head and hose assembly outwardly from a take-up reel into the pool itself, so that the pool cleaning cycle may be initiated without requiring manual effort.

Figure 1:
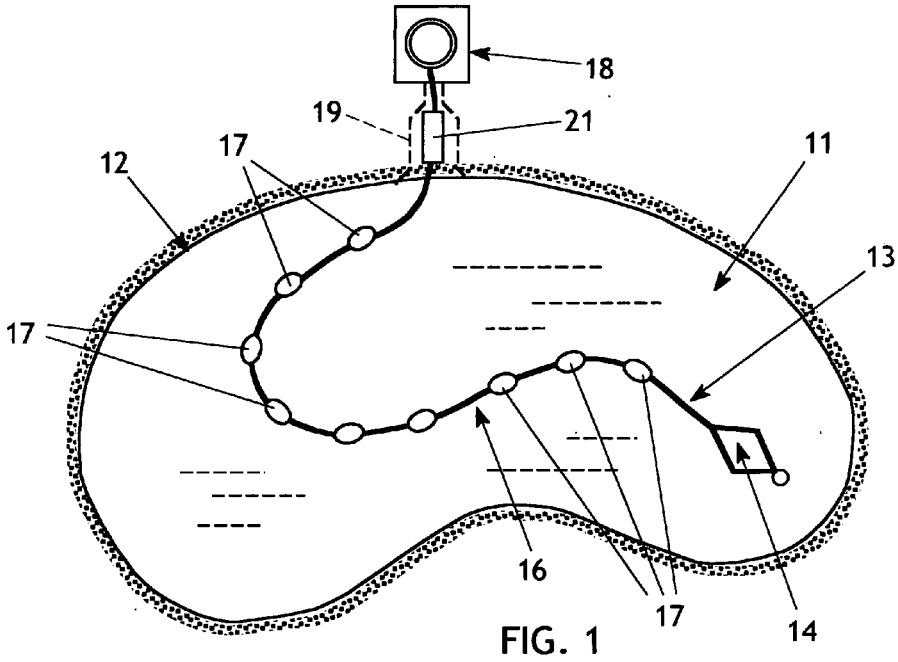
FIG. 1 is a plan view of the apparatus of the invention used in a typical pool installation.

With regard to FIG. 1, a typical swimming pool 11 is defined by a pool wall 12 (the shape is irrelevant). A pool cleaning apparatus 13 known in the prior art includes a cleaning head 14 secured to the distal end of a hose assembly 16, the hose providing pressurized water to power the cleaning head to randomly traverse the pool floor and pick up sunken leaves and dirt. The hose assembly includes a plurality of floats 17 spaced therealong and joined fixedly thereto. Typically, the floats are spaced at about 2–3 feet, and have a diameter of about 2–3 inches. The hose assembly is stored on a reel assembly 18 located adjacent to the pool wall 12, and the cleaning head 14 is stored in a receptacle or garage 19.

It may be appreciated that the hose assembly 13 may be withdrawn from the pool by operating the reel assembly 18 to reel in the hose until the cleaning head is pulled into the receptacle 19. However, the reverse process does not work very well, due to the fact that the flexible hose 16 cannot be pushed outwardly into the pool. The present invention overcomes this difficulty by providing a hose assembly deployment apparatus 21.

Figure 2:
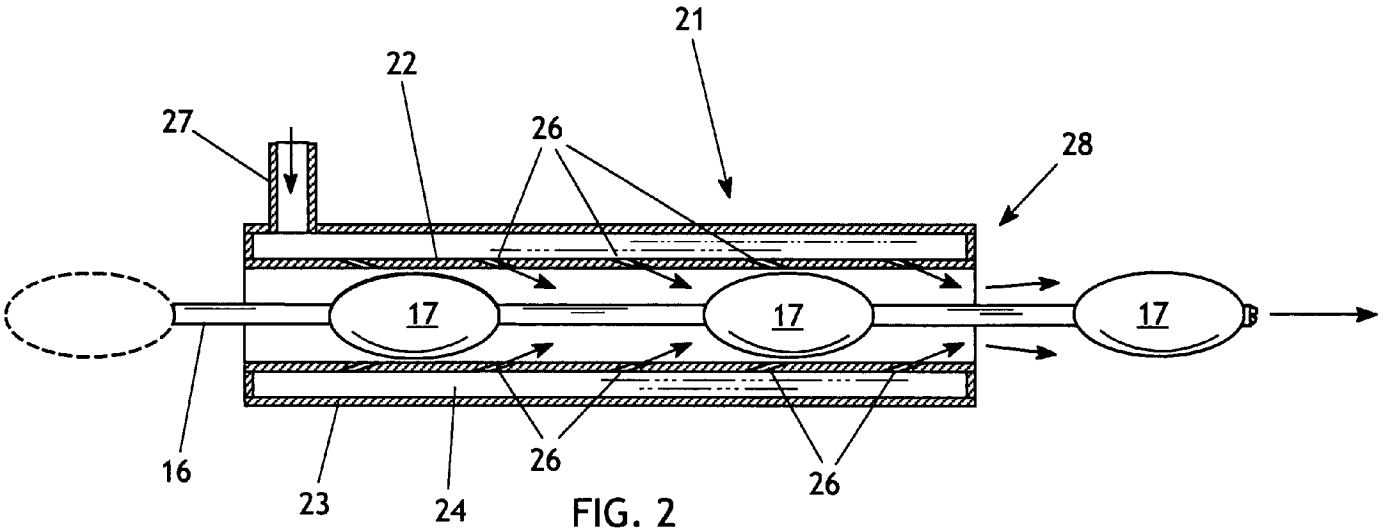
FIG. 2 is a cross-sectional elevation of one embodiment of the hose assembly deployment apparatus of the invention.

With regard to FIG. 2, one embodiment of the apparatus 21 includes a tube 22 open at both ends and having an inside diameter slightly larger than the outside diameter of the floats 17, so that the floats and the hose assembly 13 may pass through the tube 22 with minimal friction, while the floats comprise a flow restriction through the tube 22. Another tube 23 surrounds the tube 22 concentrically, and end seals at like ends of the tubes 22 and 23 define therebetween a concentric pressure chamber 24. A connector 27 supplies pressurized water to the pressure chamber 24. The tube 22 is provided with a plurality of jet openings 26 spaced circumferentially and longitudinally, the jets being angled obliquely toward the outer end 28 of the assembly.

The jets 26 flood the tube 22 with water surging toward the outlet end 28. Due to the fact that the ID of the tube 22 is only slightly larger than the OD of the floats 17, the floats 17 are subject to a piston or bullet effect in which the pressure and momentum of the jets 26 forces the floats 17 toward the outlet end 28, thus driving the hose assembly l3 outwardly to the pool. The length of the jet tube assembly 21 is sufficient to assure that at least one, and preferably two floats 17 are entrained in the tube 22 at any instant, thereby assuring outward propulsion is continuous and that the entire hose assembly is fed out into the pool 11.

The assembly 21 may be fabricated using standard plastic pipe sections, such as 2 inch and 3 inch diameter pipes. Note that the jets 26 are needed only to deploy the hose assembly and, once it is deployed, pressure to the jets 26 is turned off. At the end of a cleaning cycle, the hose assembly may easily be retracted by driving the reel assembly 18 to pull the hose assembly freely through the tube 22.

Figure 3:
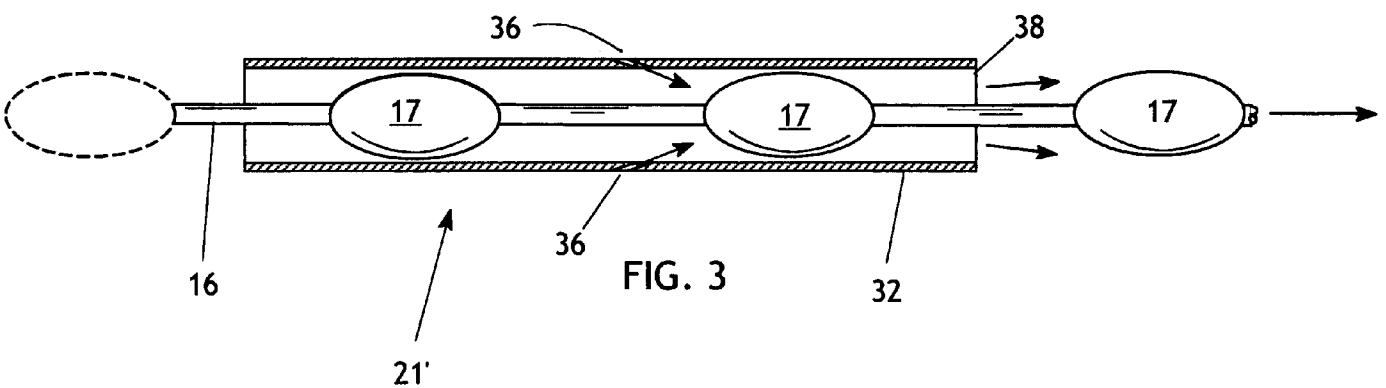
FIG. 3 is a cross-sectional elevation of a further embodiment of the hose assembly deployment apparatus of the invention.

With regard to FIG. 3, a further embodiment of the invention, designated 21', is a simplified assembly that also makes use of water jets to deploy the hose assembly. A tube 32 is open at both ends, and is dimensioned similarly to tube 22 of the previous embodiment. A pair of water jets 36 extend through the sidewall of the tube 32, and are angled toward the outlet end 38, the jets being connected to a source of pressurized water. The jets 36 propel the floats of the hose assembly toward the distal end 38 by their momentum and the pressure behind the floats 17, whereby the entire hose assembly may be pulled from the reel assembly 18 to deploy the pool cleaner in the swimming pool. Thereafter the jets 36 are turned off and the cleaning head is operated by pressurized water delivered through the hose 16.

Figure 4:
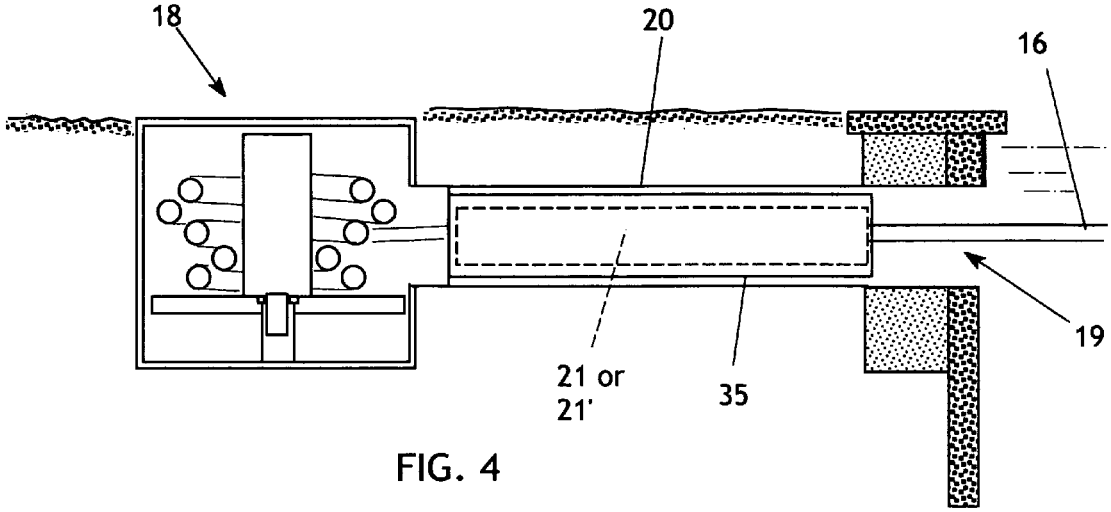
FIG. 4 is a cross-sectional elevation of the embodiment of FIG. 2 installed in a typical swimming pool.

With reference to FIG. 4, there is shown the invention (either embodiment 21 or 21') installed in a typical swimming pool site, with the reel assembly 18 removed from the pool sidewall by the length of the tunnel 20. In conjunction with either embodiment, the invention may also provide an outer tube or pipe 35 extending concentrically about the water jet deployment apparatus of the invention. The space between the tube 35 and the tunnel wall allows water to be drawn from the pool and replace the water drawn from the storage area during operation of the jet assembly. The water pressure within the reel assembly housing may be maintained at zero pressure or slightly negative pressure.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. In a swimming pool cleaning device having a flexible hose supported by a plurality of floats secured therealong, an apparatus for driving the hose into the pool from a storage area, including:

a first tube open at both ends and having one of said ends disposed in communication with the pool, said hose extending through said first tube;

a plurality of water jets in said first tube, said jets being angled obliquely toward said one end to emit water streams toward said one end;

said water streams impinging on said floats to push said floats and said hose toward said one end of said first tube, whereby said hose is driven into the pool.

2. The apparatus of claim 1, wherein said first tube has an inside diameter sufficient to pass said floats in freely translating fashion.

3. The apparatus of claim 1, wherein said first tube has an inside diameter slightly larger than the outside diameter of said floats, whereby said water streams create a piston effect in conjunction with said floats to drive said floats toward said one end of said first tube.

4. The apparatus of claim 1, wherein said first tube is sufficiently long to entrain at least two of said floats therewithin at any one time.

5. The apparatus of claim 1, further including an outer tube extending concentrically about said first tube, said outer tube connected between said pool and said storage area and disposed to replenish water displaced into said pool by said water streams of said jets.

6. The apparatus of claim 1, further including a second tube extending concentrically about said first tube and spaced apart therefrom, and end seals joined to like ends of the first and second tubes to define a pressure chamber therebetween.

7. The apparatus of claim 6, wherein said water jets extend from said pressure chamber into said first tube.

8. The apparatus of claim 7, wherein said water jets are spaced circumferentially and longitudinally in said first tube.

9. In a swimming pool cleaning device having a flexible hose supported by a plurality of floats secured therealong, a method for driving the hose into the pool from a storage area, including the steps of:

providing a tubular passage through which said flexible hose extends;

providing a plurality of water jets in said tubular passage, said water jets being angled toward an outlet end adjacent to the pool;

said water jets impinging on said floats and driving the floats and hose into the pool.

10. The method of claim 9, further including the step of providing a pressure chamber surrounding said tubular passage, and connecting said water jets to be supplied by said pressure chamber.

11. The method of claim 9, wherein a flow of water from the pool replaces the water drawn from the storage area by the jets.

12. The method of claim 11, wherein said flow of water from the pool passes through a tunnel connecting said storage area and the pool.

13. The method of claim 9, wherein the water pressure within said storage area is maintained between zero pressure and negative pressure.

* * * * *